US012134533B2

(12) United States Patent
Matsumoto

(10) Patent No.: US 12,134,533 B2
(45) Date of Patent: Nov. 5, 2024

(54) SHEET STORAGE DEVICE AND IMAGE FORMING APPARATUS

(71) Applicant: CANON KABUSHIKI KAISHA, Tokyo (JP)

(72) Inventor: Yasuaki Matsumoto, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 205 days.

(21) Appl. No.: 17/833,218

(22) Filed: Jun. 6, 2022

(65) Prior Publication Data

US 2022/0388792 A1 Dec. 8, 2022

(30) Foreign Application Priority Data

Jun. 8, 2021 (JP) ..... 2021-096223

(51) Int. Cl.
*B65H 1/04* (2006.01)
*B65H 1/02* (2006.01)

(52) U.S. Cl.
CPC ..... *B65H 1/04* (2013.01); *B65H 1/022* (2013.01); *B65H 1/027* (2013.01); *B65H 2405/1122* (2013.01); *B65H 2405/1124* (2013.01); *B65H 2511/11* (2013.01); *B65H 2801/06* (2013.01)

(58) Field of Classification Search
CPC ... B65H 1/04; B65H 1/12; B65H 1/14; B65H 2405/112; B65H 2405/1122; B65H 2405/1124; B65H 2405/12; B65H 2511/11
See application file for complete search history.

(56) References Cited

U.S. PATENT DOCUMENTS

2017/0313528 A1* 11/2017 Yang ..... B65H 9/04
2017/0315489 A1* 11/2017 Kuroda ..... G03G 15/6502
2022/0119212 A1* 4/2022 Fukushima ..... B65H 3/56

FOREIGN PATENT DOCUMENTS

JP H09118439 A 5/1997

* cited by examiner

*Primary Examiner* — Prasad V Gokhale

(74) *Attorney, Agent, or Firm* — Canon U.S.A., Inc. IP Division

(57) ABSTRACT

A sheet storage device includes a sheet storage unit to store sheets, a regulating unit in the sheet storage unit, and a lifting unit. The regulating unit regulates a position of a rear edge portion of the sheets in a sheet conveyance direction and includes a supporting portion, an urging member, and a pressing portion having a pressing surface in which a position to be in contact with lower sheets is a pressing surface lower portion, and a position to be in contact with upper sheets located higher than the lower sheets is a pressing surface upper portion. The pressing surface can be in a first state, where the pressing surface upper portion is located downstream from the pressing surface lower portion in a pressing direction, or in a second state, where the pressing surface lower portion is located downstream from the pressing surface upper portion in the pressing direction.

11 Claims, 11 Drawing Sheets

SHEET STORAGE DEVICE AND IMAGE FORMING APPARATUS

This application claims the benefit of Japanese Patent Application No. 2021-096223, filed Jun. 8, 2021, which is hereby incorporated by reference herein in its entirety.

BACKGROUND

Field

The present disclosure relates to an image forming apparatus, such as a copier and a printer, and a sheet storage device used for the image forming apparatus.

Description of the Related Art

An image forming apparatus in which a sheet is conveyed to an image forming unit to form an image on the sheet typically has a sheet storage device including a sheet stacking tray for stacking sheets, and a sheet feeding roller (a sheet feeding member) that conveys a sheet from the sheet storage device in a conveyance direction. One type of such a sheet storage device has a regulating unit (a rear edge regulating unit) that regulates the rear edge portion of sheets in a conveyance direction.

Another type of sheet storage device has a lift plate that lifts sheets toward a sheet feeding roller. The lift plate lifts the front edge portion of the sheets in a conveyance direction, thereby maintaining the front edge portion of the sheets at such a height that it is possible to come into contact with the sheet feeding roller.

When the quantity of sheets stacked on the sheet stacking tray decreases, the front edge portion and the rear edge portion of the stacked sheets in the conveyance direction are both at low positions. Here, if there is an increase in the amount of lifting up of the lift plate to bring the sheet feeding roller and the front edge portion of the sheets close to each other, the distance from the rear edge portion of the sheets to the sheet feeding roller also increases. The position of the front edge portion of the sheets with respect to the sheet feeding roller is thereby shifted to the upstream side in the conveyance direction. As a result, an image defect or a paper jam can occur due to a sheet conveyance delay.

To address this issue, there is discussed a configuration in which a pressing portion to be urged toward a sheet rear edge by an urging member is disposed in a rear edge regulating unit, and the sheet rear edge is pushed up by the pressing portion depending on a lift-up angle of stacked sheets (Japanese Patent Application Laid-Open No. 9-118439).

In the configuration of Japanese Patent Application Laid-Open No. 9-118439, however, there is an issue that it is difficult to adjust the urging force of the urging member. The details will be described below.

The pressing portion of the rear edge regulating unit is configured to move the whole of the sheets stacked on the sheet stacking tray. Thus, a large urging force is desirable to push out the sheets in a state where the quantity of the stacked sheets is large. Meanwhile, it is desirable to set the urging force to prevent sheet buckling from occurring in a state where the quantity of the stacked sheets is small. If the urging force is set to prevent sheet buckling from occurring in a state where the quantity of the stacked sheets is small, there may be a case where the sheets cannot be pushed out in a state where the quantity of the stacked sheets is large.

SUMMARY

According to an aspect of the present disclosure, a sheet storage device includes a sheet storage unit configured to store sheets, a regulating unit disposed in the sheet storage unit, and configured to regulate a position of a rear edge portion of the sheets in a conveyance direction for the sheets, wherein the regulating unit includes a pressing portion having a pressing surface configured to press the rear edge portion, a supporting portion configured to support the pressing portion, and an urging member configured to urge the pressing portion to cause the pressing surface to press the sheets, and a lifting unit configured to lift a front edge portion of the sheets in the conveyance direction, wherein, in the pressing surface, a position to be in contact with lower sheets is a pressing surface lower portion, and a position to be in contact with upper sheets located higher than the lower sheets is a pressing surface upper portion, wherein, in a case where a direction parallel to a horizontal direction and toward a downstream side in the conveyance direction is a pressing direction and depending on a quantity of the sheets stored in the sheet storage unit, the pressing surface can be in a first state or a second state, wherein, in the first state, the pressing surface upper portion is located downstream from the pressing surface lower portion in the pressing direction, and wherein, in the second state, the pressing surface lower portion is located downstream from the pressing surface upper portion in the pressing direction.

Further features of the present disclosure will become apparent from the following description of exemplary embodiments with reference to the attached drawings.

DESCRIPTION OF THE EMBODIMENTS

[Overall Configuration]

Figure 1:
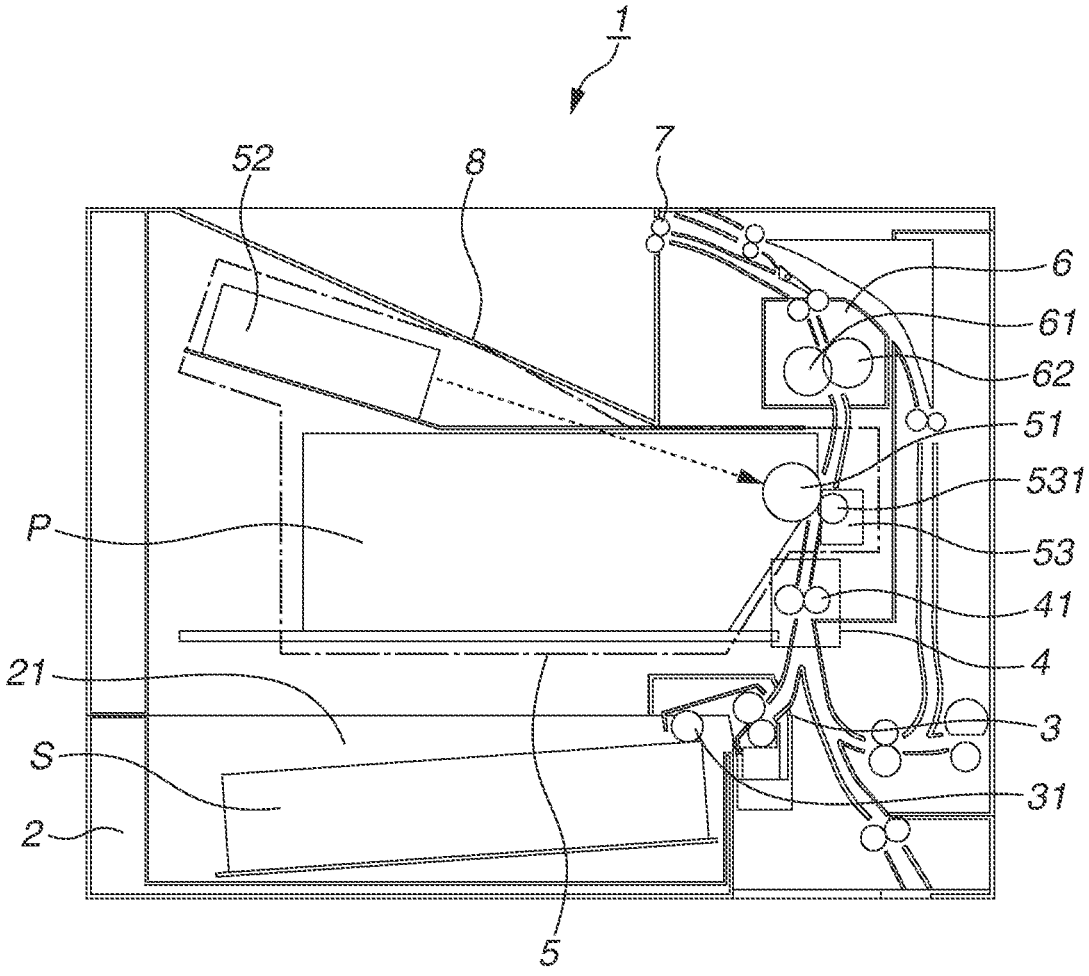
FIG. 1 is a cross-sectional view of an overall configuration of a main body of an image forming apparatus.

FIG. 1 is a schematic cross-sectional view of an overall configuration of an image forming apparatus 1. The image forming apparatus 1 forms an image by using an electrophotographic recording method. The image forming apparatus 1 conveys a sheet (a recording material) S to an image forming unit 5 to transfer a toner image to the sheet S, conveys the sheet S to a fixing unit 6 to fix the toner image on the sheet S, and subsequently discharges the sheet S to a discharge unit.

Sheets S are stacked and stored on a stacking surface of a sheet storage unit 21 of the sheet storage device 2 mounted on the bottom of the image forming apparatus 1. The sheets S are sequentially sent out starting from the uppermost sheet by a sheet feeding roller 31 serving as a conveying unit that conveys a sheet in a conveyance direction. The sheet feeding roller 31 is disposed in a supply unit 3 for supplying the sheet S to the image forming unit 5. The sheet S sent out by the sheet feeding roller 31 is conveyed to a conveyance unit 4 disposed downstream from the sheet storage device 2 in the conveyance direction, and subsequently sent to the image forming unit 5 by a conveyance roller pair 41.

In the image forming unit 5, a photosensitive drum 51 is irradiated with a laser beam based on image information by a laser scanner 52, and thereby an electrostatic latent image is formed on the photosensitive drum 51. Subsequently, toner development is performed in a developing unit (not illustrated) in a process cartridge P, so that a toner image is formed. This toner image is transferred as an unfixed image to the sheet S that has been sent to the image forming unit 5, by bias application onto a transfer roller 531 in a transfer unit 53. Subsequently, the sheet S is sent to the fixing unit 6.

The fixing unit 6 forms a fixing nip by a heating unit 61 and a pressure roller 62 in pressure contact with the heating unit 61. The heating unit 61 is composed of a fixing film and a heating unit, such as a ceramic heater, that is disposed on the inner surface side of the fixing film. The sheet S passes through the fixing nip, so that the unfixed image is permanently fixed to the sheet S. The sheet S is then discharged by a discharge roller pair 7 to the outside of the image forming apparatus 1 via a sheet discharge path, and placed on a discharge tray 8.

In the present exemplary embodiment, an electrophotographic image forming process using the transfer unit and the fixing unit is adopted as an image forming unit that forms an image on the sheet S, but the present disclosure is not limited thereto.

For example, the present disclosure may use an inkjet image forming process that forms an image on a sheet by ejecting an ink liquid from a nozzle serving as the image forming unit that forms an image on the sheet S.

[Sheet Storage Device]

Figure 2:
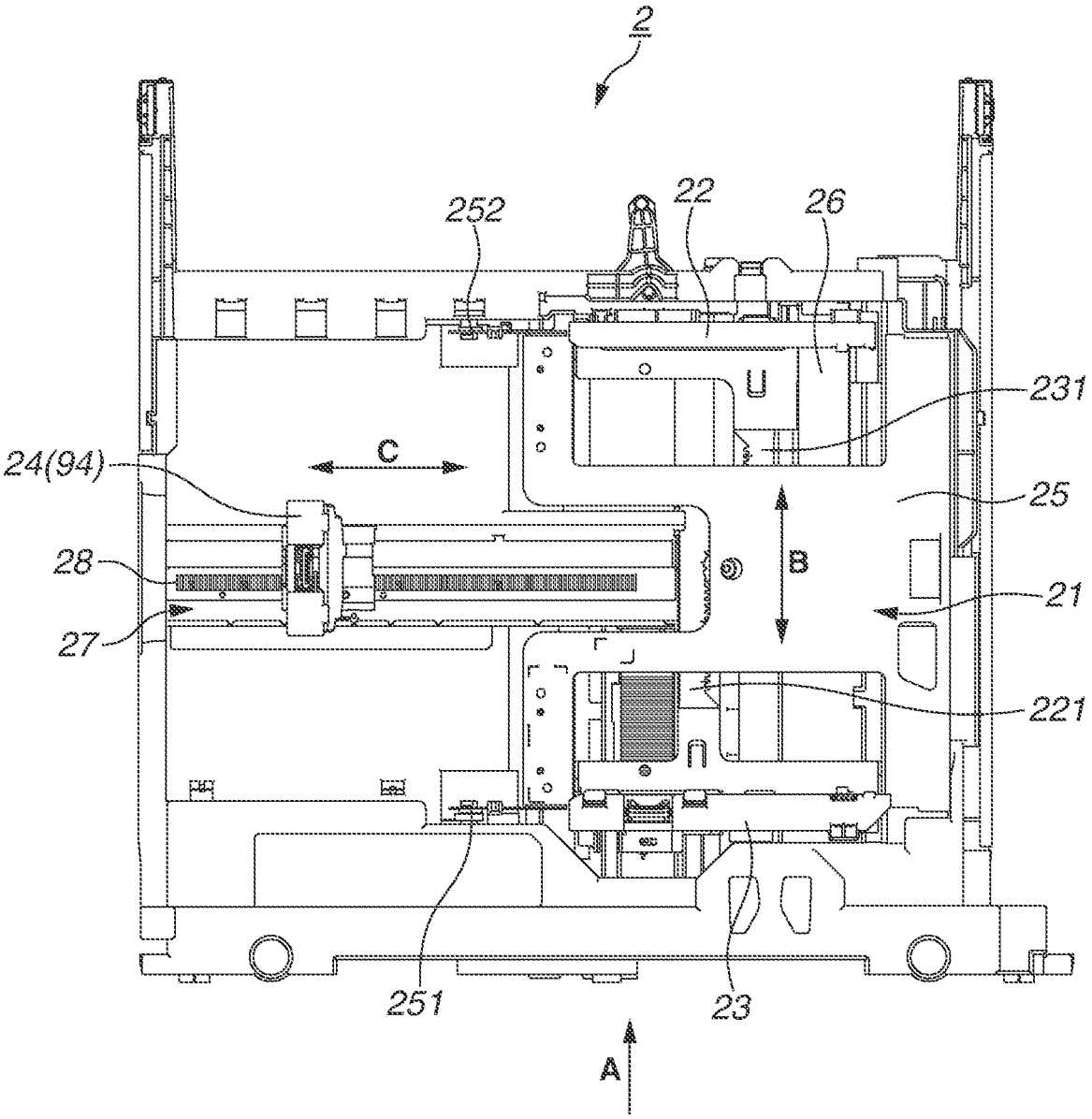
FIG. 2 is a plan view of a schematic configuration of a sheet storage device disposed in the image forming apparatus.
Figure 5:
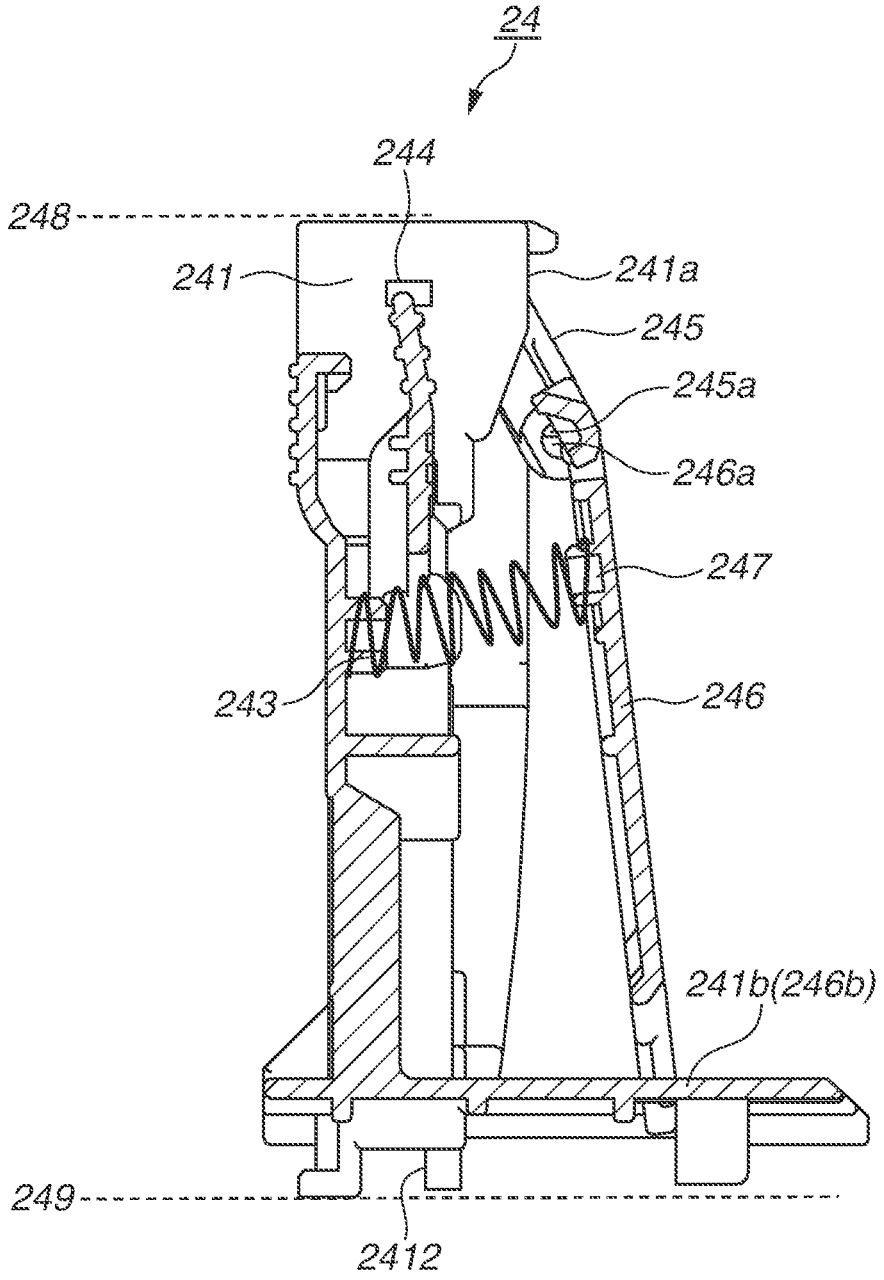
FIG. 5 is a cross-sectional view of the regulating unit according to the first exemplary embodiment of the present disclosure.

A detailed configuration of the sheet storage device 2 mounted on the image forming apparatus 1 will now be described with reference to FIG. 2 and FIG. 5. FIG. 2 is a plan view of a schematic configuration of the sheet storage device 2 that can store sheets S of different sizes, and FIG. 5 is a cross-sectional view of a regulating unit 24.

The sheet storage device 2 illustrated in FIG. 2 includes the sheet storage unit 21 for stacking and storing the sheets S of different sizes, a pair of width regulating units 22 and 23 that regulate the side edge positions of the sheets S, and the regulating unit 24 that regulates the rear edge position of the sheets S. The sheet storage device 2 further includes an intermediate plate 25 that brings the stacked sheets S into contact with a lift arm 26 pivotably disposed, pushes up the sheets S by pivoting about intermediate plate spindles 251 and 252, and brings the stacked sheets S into contact with a sheet feeding roller 31. The width regulating units 22 and 23 and the regulating unit 24 are each disposed at a position not affecting the pivot operation of the intermediate plate 25.

When sheets S of different sizes are to be stored in the sheet storage unit 21, the width regulating units 22 and 23 and the regulating unit 24 are each set at a position corresponding to the sheets S to be stored. The sheets S can thereby be stored at an appropriate position. The sheet storage device 2 can be attached by being moved in an arrow-A direction with respect to the image forming apparatus 1. When a sheet S is conveyed, the lift arm 26 is pivoted by a pivot mechanism (not illustrated) in the main body, so that the intermediate plate 25 is pivoted upward about the intermediate plate spindles 251 and 252. The sheets positioned by the width regulating units 22 and 23 and the regulating unit 24 are thereby pressed against the sheet feeding roller 31.

The pair of regulating units 22 and 23 respectively have rack portions 221 and 231 extending in the width direction (an arrow-B direction) on the bottom portion of the sheet storage unit 21. A rack teeth (not illustrated) formed in the rack portion 221 and that in the rack portion 231 mesh with each other via a pinion gear (not illustrated). When either one of these width regulating units is moved in the width direction, the other width regulating unit thereby moves in the direction opposite to the one width regulating unit in an interlocking manner, by the action of the pinion gear and the rack portions 221 and 231. The positions of the width regulating units 22 and 23 are fixed by fitting a fixing unit (not illustrated) provided in each of the width regulating units 22 and 23 into a groove of the sheet storage unit 21.

The regulating unit 24 can move in a groove portion 27 provided along a direction C. The groove portion 27 has an uneven portion 28 extending in the direction C, and the regulating unit 24 is positioned by engagement of the uneven portion 28 with a protruding portion 2412 of the regulating unit 24. The engagement of the protruding portion 2412 with the uneven portion 28 is released by a user operation of a lever member 244. In this state, the regulating unit 24 is moved on the groove portion 27 and is positioned at an arbitrary place corresponding to the size of the sheets S.

Figure 3:
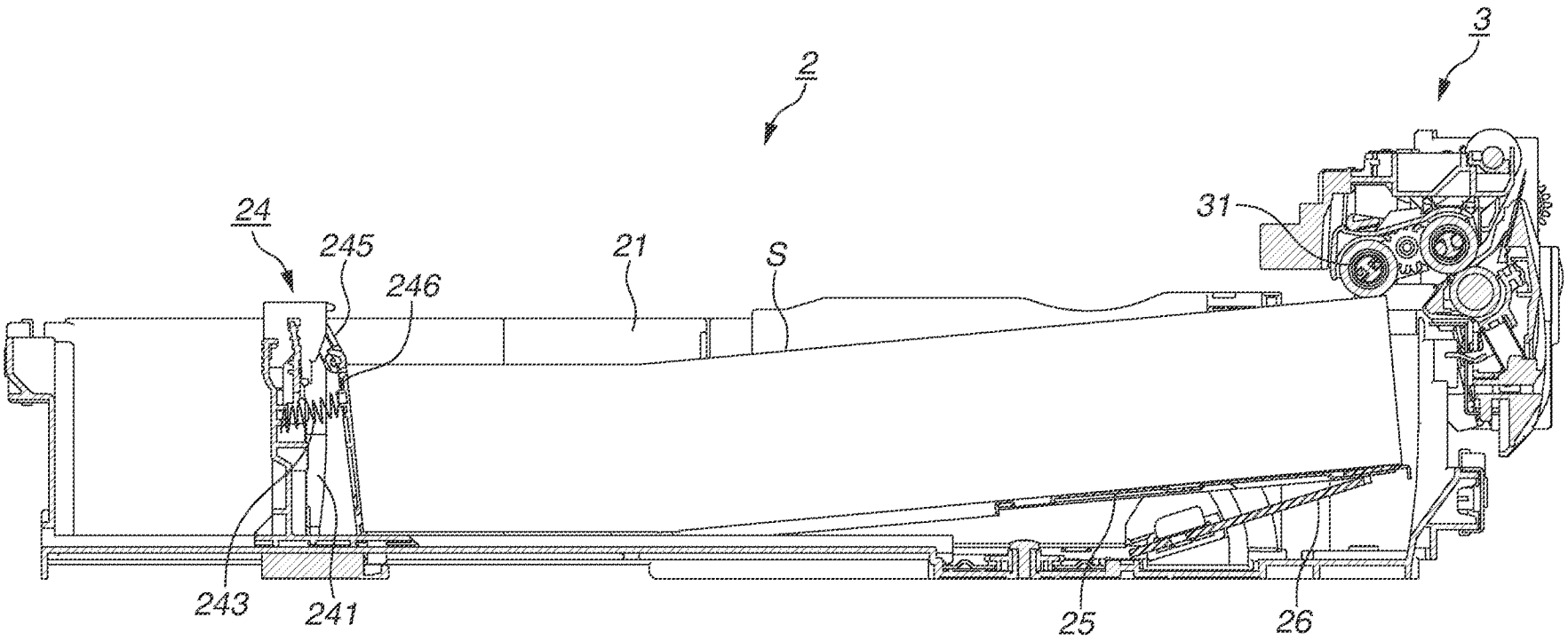
FIG. 3 is a cross-sectional view of a schematic configuration of the sheet storage device disposed in the image forming apparatus.
Figure 4:
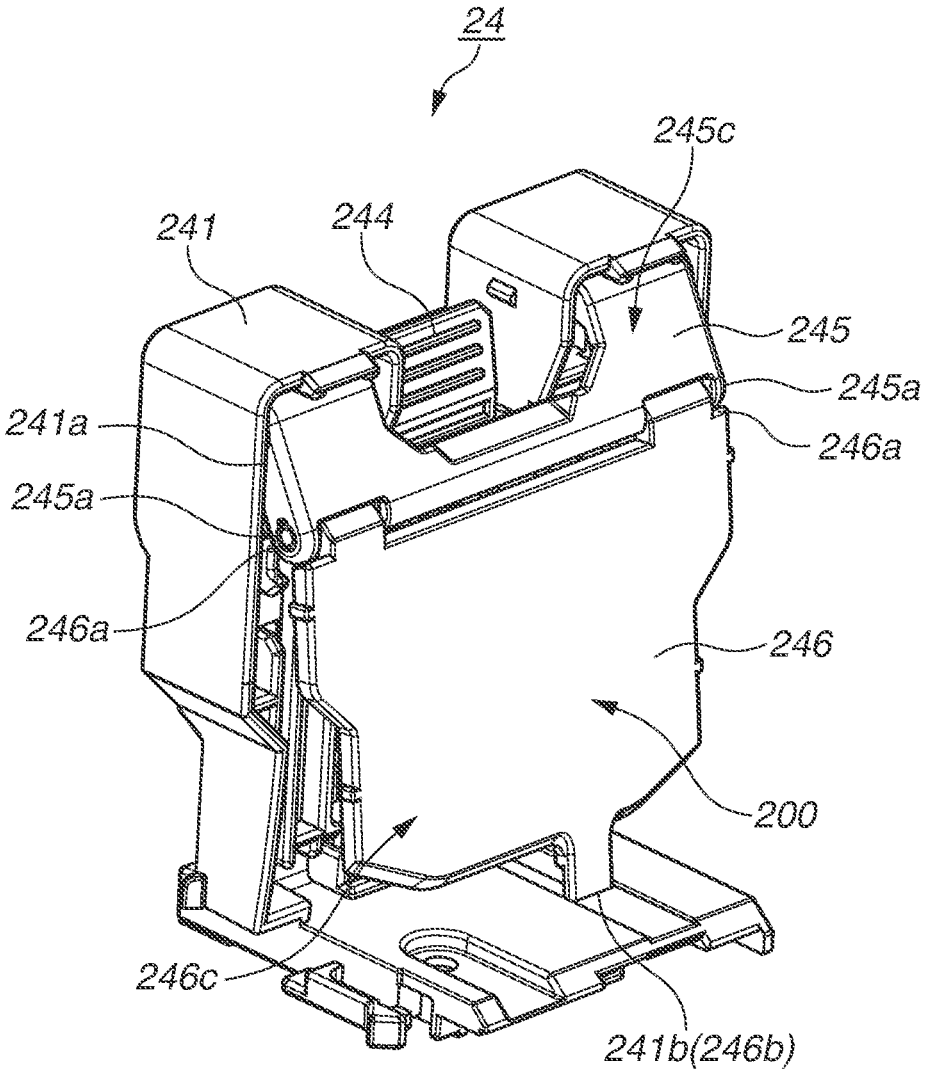
FIG. 4 a perspective view of a regulating unit according to a first exemplary embodiment of the present disclosure.

A first exemplary embodiment in the present disclosure will now be described with reference to FIGS. 3 to 7C. FIG. 3 is a cross-sectional view of the sheet storage device 2 according to the first exemplary embodiment. FIG. 4 is a perspective view of the regulating unit 24 that positions the rear edge of the sheets S stacked in the sheet storage unit 21. FIG. 5 is a cross-sectional view of the regulating unit 24. FIGS. 6A to 6C and FIGS. 7A to 7C are diagrams illustrating movement of a pressing portion 200.

The regulating unit 24 includes the pressing portion 200, a supporting portion 241, and an urging member 243. The pressing portion 200 has a first portion 245 and a second portion 246. The first portion 245 and the second portion 246 can pivotally move with respect to the supporting portion 241, and the second portion 246 is located below the first portion 245. The first portion 245 and the second portion 246 have a pressing surface that presses the rear edge portion of the sheets S. The pressing surface here, however, indicates a surface pressing the sheets S, and varies depending on the quantity of the stacked sheets S.

The regulating unit 24 has the urging member 243 that urges the pressing portion 200 so that the sheets S are pressed by the pressing surface. A first surface 245*c* of the first portion 245 is a surface pressing the sheets S at the time of a third quantity described below. A second surface 246*c* of the second portion 246 is a surface that can be in contact with the lowermost sheet among the sheets stacked in the sheet storage unit 21. The second surface 246*c* is a surface pressing the sheets when the quantity of the sheets is each of a first quantity and a second quantity described below. In the present exemplary embodiment, the second surface 246*c* is a flat surface.

The first portion 245 is held by the supporting portion 241, and a part of the first portion 245 is fit in a shaft portion (not illustrated) of the supporting portion 241, so that the first portion 245 can pivot about the shaft portion.

The second portion 246 is held by the first portion 245, and an engagement portion 246*a* of the second portion 246 is engaged with a connecting portion 245*a* of the first portion 245, so that the second portion 246 can pivot about the engagement portion 246*a*.

The engagement portion 246*a* is located at a position closer to an upper end 248 than to a lower end 249 of the regulating unit 24 in the vertical direction, according to the present exemplary embodiment. In a state where the sheets S are not stored in the sheet storage device 2, the first portion 245 and the second portion 246 are in a state of being urged by the urging member 243 as illustrated in FIG. 5, and pivoted to be more rightward in FIG. 5 than the supporting portion 241. The pivotal movement of the second portion 246 is regulated by bringing a contact surface 246*b* thereof into contact with a pivotal movement regulating unit 241*b* of the supporting portion 241, so that the largest pivotal movement position is determined.

The second portion 246 is attached to be pivotable with respect to the first portion 245, so that the second portion 246 is configured to enable an upper part to pivot even if a lower part does not move, when the urging force of the urging member 243 is applied. By having this configuration, the second portion 246 preferentially pushes out the upper side of the stacked sheets S.

Although a force used for the pressing portion 200 to push out the uppermost sheet among the stacked sheets S is independent of the height of the stacked sheets S, it is desirable to push out lower sheets together with upper sheets when the quantity of stacked sheets is large. Thus, a pressing force to be applied near the uppermost sheet among the sheets S by the second portion 246 needs to be greater, as the height of the stacked sheets S is higher. In contrast, when the quantity of the stacked sheets S is small, it is desirable to limit a load to a level that prevents the bundle of the sheets S from buckling because of the pressing force of the second portion 246. The urging position and the urging force are set to meet the two conditions described above.

The urging member 243 urges an urged portion 247 of the second portion 246. In the present exemplary embodiment, the urged portion 247 is disposed at a position lower than the engagement portion 246*a*, and closer to the upper end 248 than to the lower end 249 of the regulating unit 24. It is desirable to dispose the urged portion 247 at such a position, in order to obtain more effect of preferentially pushing out the upper sheets S. However, the urged portion 247 may be disposed anywhere as long as the urged portion 247 is located at a position higher than the lowermost sheet among the sheet S stored in the sheet storage unit 21.

The pivotal movement posture of the pressing portion 200 is determined such that a desirable amount of pressing force is secured depending on the height of the stacked sheets S. The supporting portion 241 is also provided with a stacked-sheet contact surface 241*a* to be in contact with the rear edge of the sheets S when the quantity of the stacked sheets S is large.

Figure 6A:
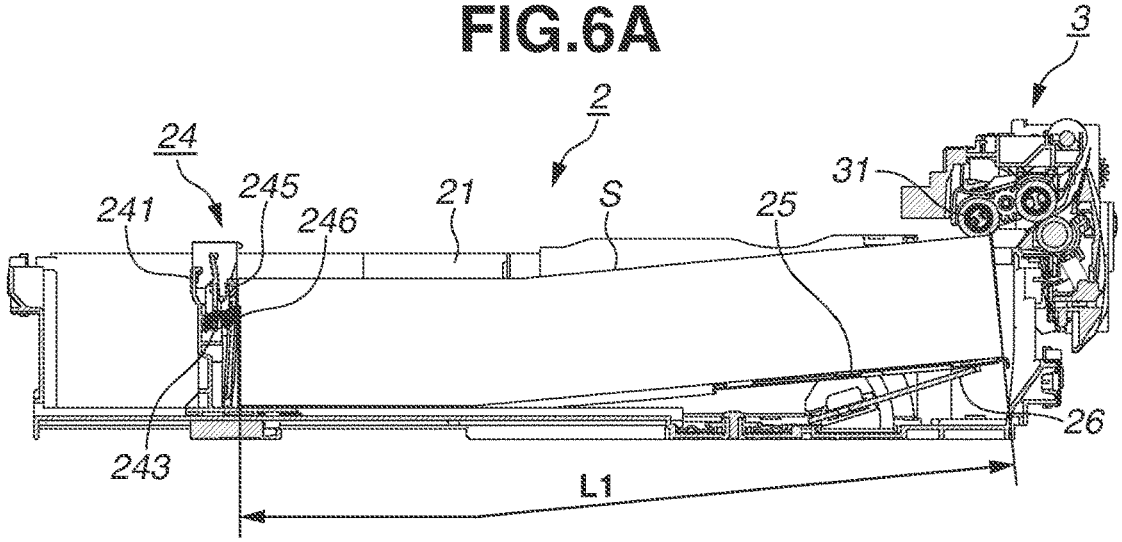
FIGS. 6A to 6C are cross-sectional views each illustrating a use state of a sheet storage device according to the first exemplary embodiment of the present disclosure.
Figure 6B:
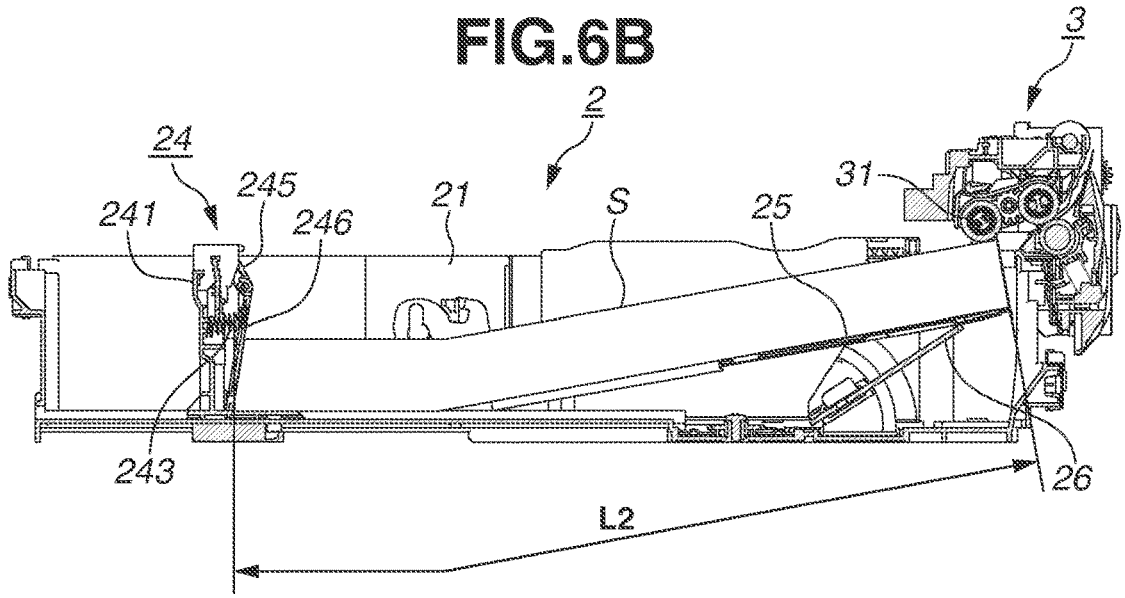
Figure 6C:
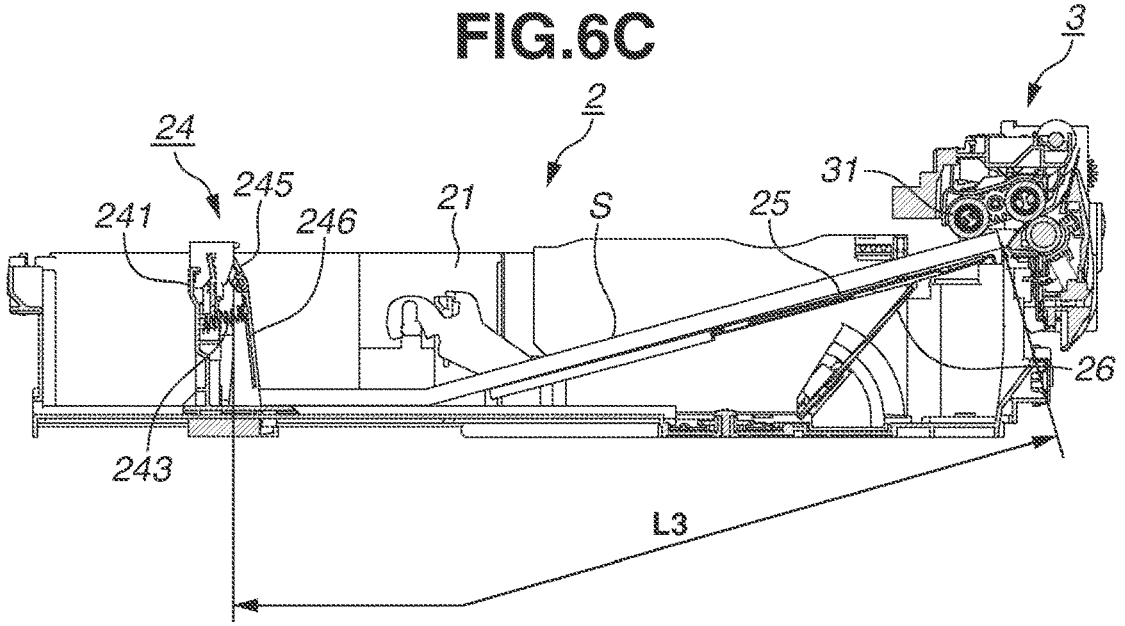
Figure 7A:
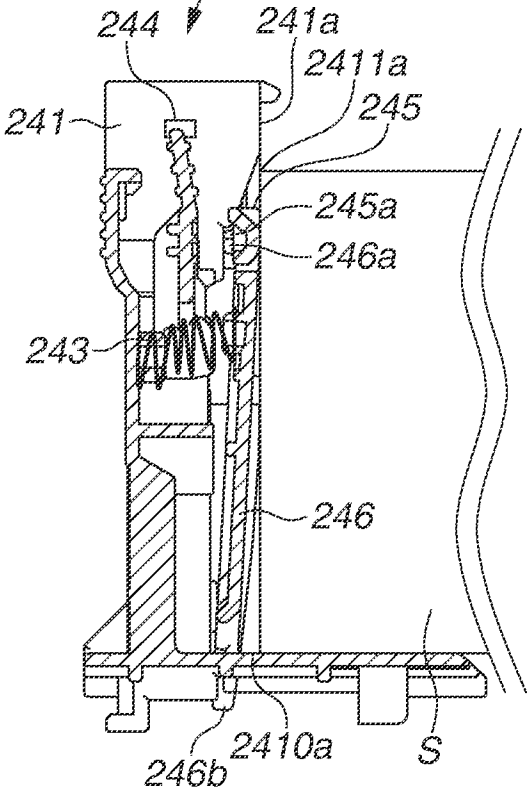
FIGS. 7A to 7C are cross-sectional views each illustrating a use state of the regulating unit according to the first exemplary embodiment of the present disclosure.
Figure 7B:
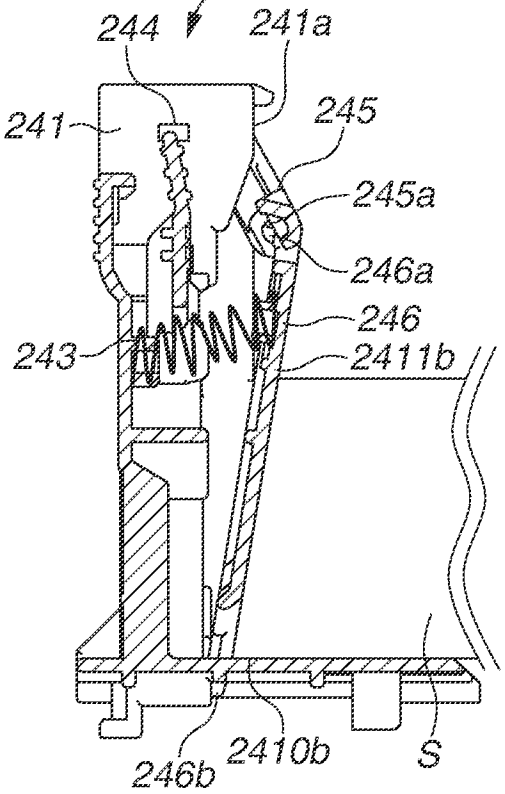
Figure 7C:
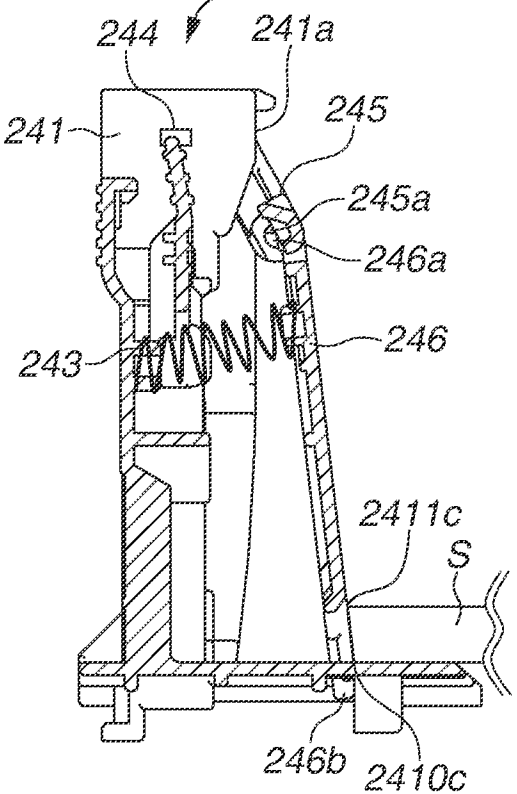

The state of the first portion 245 and the second portion 246 when the sheets S are stacked in the sheet storage device 2 will be described with reference to FIGS. 6A to 6C and FIGS. 7A to 7C, in a case where the quantity of the stacked sheets S is each of three patterns, i.e., the third quantity, the first quantity, and the second quantity. FIG. 6A and FIG. 7A illustrate the case of the third quantity, FIG. 6B and FIG. 7B illustrate the case of the first quantity, and FIG. 6C and FIG. 7C illustrate the case of the second quantity. The third quantity is larger than the first quantity, and the first quantity is larger than the second quantity. Specifically, in the present exemplary embodiment, the third quantity, the first quantity, and the second quantity will be described as a state where 90% is stored, a state where 50% is stored, and a state where 10% is stored, respectively, with respect to the acceptable quantity of the sheets S that can be stored in the sheet storage unit 21. However, the present exemplary embodiment is not limited to these quantities.

Before the description of a configuration of the present exemplary embodiment, there will be considered a configuration in which the pressing portion 200 is not present, the rear edge portion of the sheets S is regulated by the regulating unit, and the front edge of the sheets S is lifted up. In the state where the quantity of the sheets S is the third quantity, as illustrated in FIG. 6A, the distance from the rear edge of the uppermost sheet of the stacked sheets to the contact point between the sheet and the sheet feeding roller 31 along the surface of this sheet is a distance L1. In the state where the quantity of the sheets S is the first quantity, as illustrated in FIG. 6B, the distance is a distance L2, which is longer than the distance L1. Further, in the state where the quantity of the sheets S is the second quantity, as illustrated in FIG. 6C, the distance is a distance L3, which is longer than the distance L2.

The configuration of the present exemplary embodiment in which the pressing portion 200 is present will be described. When the quantity of the stacked sheets S is the third quantity, as illustrated in FIG. 7A, the first portion 245 and the second portion 246 are in contact with the rear edge of the sheets S, in a state of not protruding from the supporting portion 241, while urging the sheets S.

At this moment, an angle formed by the pressing surface pressing the sheets S and the vertical direction is small (the third state), as compared with an angle in each of the first state and the second state to be described below.

Here, in the pressing surface, a position to be in contact with the lower sheets S stacked in the sheet storage unit 21 will be referred to as the pressing surface lower portion, and a position to be in contact with the sheets S located higher than the lower sheets S will be referred to as the pressing surface upper portion. In other words, the pressing surface has the pressing surface lower portion to be in contact with the sheets S and the pressing surface upper portion to be in contact with the sheets S at a position higher than the pressing surface lower portion.

When the quantity of the stacked sheets S is the first quantity, the pressing surface inclines as illustrated in FIG. 7B, so that the first portion 245 and the second portion 246 pivot from the supporting portion 241 in the rightward direction in FIG. 7B. Here, the distance from the rear edge of the uppermost sheet to the position where the sheet S and the sheet feeding roller 31 are in contact with each other will be referred to as a contact distance. A decrease in the quantity of the stacked sheets S and lifting up of the intermediate plate 25 increase the contact distance. When the pressing surface pivots, the uppermost sheet S to be fed next by the sheet feeding roller 31 is moved in the conveyance direction, and the contact distance decreases. In this way, the increased contact distance is adjusted.

The pressing surface upper portion and the pressing surface lower portion at this moment will be referred to as a pressing surface upper portion 2411*b* and a pressing surface lower portion 2410*b*, respectively. The position of the pressing surface lower portion 2410*b* is a position corresponding to the lowermost sheet among the sheets stacked in the sheet storage unit 21 in the height direction. The position of the pressing surface upper portion 2411*b* is a position corresponding to the uppermost sheet. A direction parallel to the horizontal direction and toward the downstream side in the conveyance direction is a pressing direction. As to the contact surface (the pressing surface) between the second portion 246 and the sheets S, the pressing surface upper portion 2411*b* is located downstream from the pressing surface lower portion 2410*b* in the pressing direction (the first state). In other words, the second surface 246*c* of the second portion 246 is in an inclined state such that the upper end of the second surface 246*c* is located downstream from the lower end of the second surface 246*c* in the pressing direction. In this state, the pressing surface and the second surface 246*c* face downward in the vertical direction.

The reason for such an inclination is that a force applied from the sheets S to the pressing surface upper portion 2411*b* is smaller than a force applied to the pressing surface lower portion 2410*b*. The pressing surface lower portion 2410*b* is thereby not pivoted by the sheets S, and the pressing surface upper portion 2411*b* is pivoted by the urging force, and inclines as illustrated in FIG. 7B.

Since the second surface 246*c* and the pressing surface incline as described above, the second portion 246 can press the upper sheets S to move the upper sheets S toward the sheet feeding roller 31. In other words, since the second surface 246*c* and the pressing surface incline as described above, the second surface 246*c* does not move the whole bundle of sheets stored in the sheet storage unit 21 in a state where the quantity of the sheets is large.

When the quantity of the stacked sheets S is the second quantity, a position corresponding to the lowermost sheet among the sheets S stacked in the sheet storage unit 21 in the height direction is a pressing surface lower portion 2410*c*, and a position corresponding to the uppermost sheet is a pressing surface upper portion 2411*c*, of the pressing surface. Concerning the contact surface (the pressing surface) between the second portion 246 and the sheets S, the pressing surface lower portion 2410*c* is located downstream from the pressing surface upper portion 2411*c* in the pressing direction (the second state).

In other words, this is a state where the second surface 246*c* of the second portion 246 inclines such that the lower end of the second surface 246*c* is located downstream from the upper end of the second surface 246*c* in the pressing direction. In this state, the pressing surface and the second surface 246*c* face upward in the vertical direction.

Even in this state, the pressing surface pivots, so that the uppermost sheet S to be fed next by the sheet feeding roller 31 is moved in the conveyance direction, and the contact distance decreases. In addition, the distance for pushing out the uppermost sheet in the second state is longer than in the first state. As described above, the increased contact distance is adjusted.

In the present exemplary embodiment, the position of the pressing surface upper portion and the position of the pressing surface lower portion are the position corresponding to the uppermost sheet and the position corresponding to the lowermost sheet, respectively, among the sheets stacked in the sheet storage unit 21, but are not limited thereto. For example, in a case where the second portion 246 does not touch the lowermost sheet among the sheets stacked in the sheet storage unit 21, a position corresponding to the lowermost sheet among sheets in contact with the second portion 246 is the position of the pressing surface lower portion. Similarly, in a case where the second portion 246 does not touch the uppermost sheet among the sheets stacked in the sheet storage unit 21, a position corresponding to the uppermost sheet among sheets in contact with the second portion 246 is the position of the pressing surface upper portion. In other words, the uppermost portion and the lowermost portion of the pressing surface can be referred to as the pressing surface upper portion and the pressing surface lower portion, respectively.

Summarizing the above, the pressing surface can be in the first state and the second state, depending on the quantity of the sheets stored in the sheet storage unit: in the first state, the pressing surface upper portion is located downstream from the pressing surface lower portion in the pressing direction, and in the second state, the pressing surface lower portion is located downstream from the pressing surface upper portion in the pressing direction. Here, if the quantity of the sheets in the first state is the first quantity, and the quantity of the sheets in the second state is the second quantity, the first quantity is larger than the second quantity. Further, when the quantity of the sheets is the third quantity, the pressing surface can be in the third state where the angle formed by the pressing surface and the vertical direction is smaller than the angle formed by the pressing surface and the vertical direction in the first state, and the angle formed by the pressing surface and the vertical direction in the second state. The third quantity is larger than the first quantity. The angle formed by the pressing surface and the vertical direction is the same as the angle formed by the second surface 246*c* and the vertical direction.

The configuration of the first exemplary embodiment makes it possible for the pressing portion 200 to push up the stacked sheets such that the sheet feeding roller 31 can be in contact with a predetermined position of the stacked sheets regardless of the quantity of the stacked sheets S, and thus, variations in the position of the sheet S when conveyance starts can be reduced, and stable sheet feeding can be achieved.

The regulating unit 24 can also appropriately set the sheets S without causing deflection of the sheets S, when a small number of the sheets S is set or thin sheets are set as the sheets S. The sheets S can be pushed up during conveyance regardless of the quantity of the stacked sheets S.

In the present exemplary embodiment, a helical compression spring is used for the urging member 243, but other type of member, such as a torsion coil spring or a flat spring, may be used as long as the member generates an urging force.

A second exemplary embodiment in the present disclosure will now be described with reference to FIG. 8 to FIG. 11C. In the first exemplary embodiment, the configuration in which the sheets S are pushed out using the two connected pressing portions is described, but the present disclosure is not limited to this configuration. In the second exemplary embodiment, an example in which the pressing portion is configured of one member and a similar effect is produced will be described.

In the present exemplary embodiment, a regulating unit 94 includes a supporting portion 941, a stacked-sheet contact surface 941*a*, a pressing portion 900, a pressing member 945, a surface 945*c*, and an urged portion 947. The pressing portion 900 includes the pressing member 945, and the pressing member 945 has the surface 945*c*. The surface 945*c* is a surface corresponding to the second surface 246*c* in the first exemplary embodiment. The surface 945*c* is a surface that can be in contact with the lowermost sheet among the sheets stacked in the sheet storage unit 21. The surface 945*c* is a surface pressing the sheets when the quantity of the sheets is each of the first quantity and the second quantity. In the present exemplary embodiment, the surface 945*c* is a flat surface.

Figure 8:
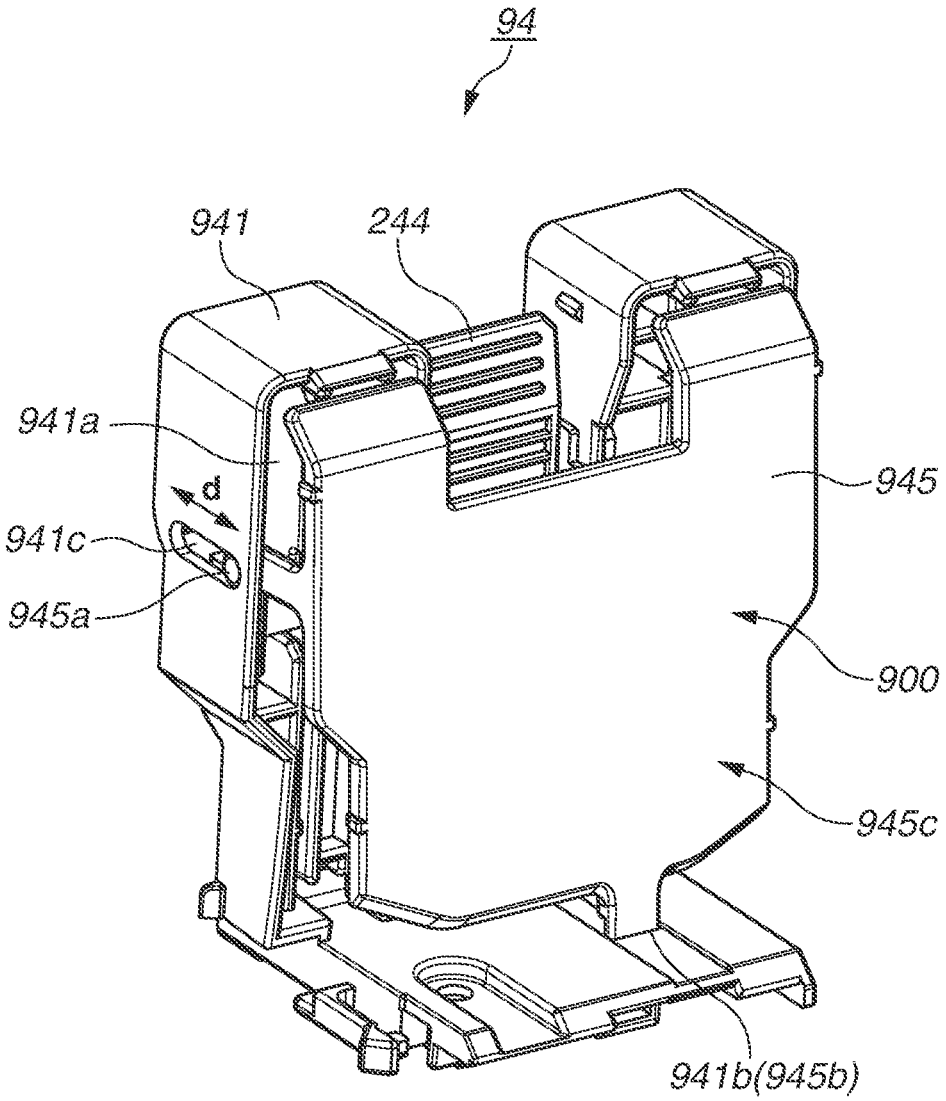
FIG. 8 a perspective view of a regulating unit according to a second exemplary embodiment of the present disclosure.
Figure 9:
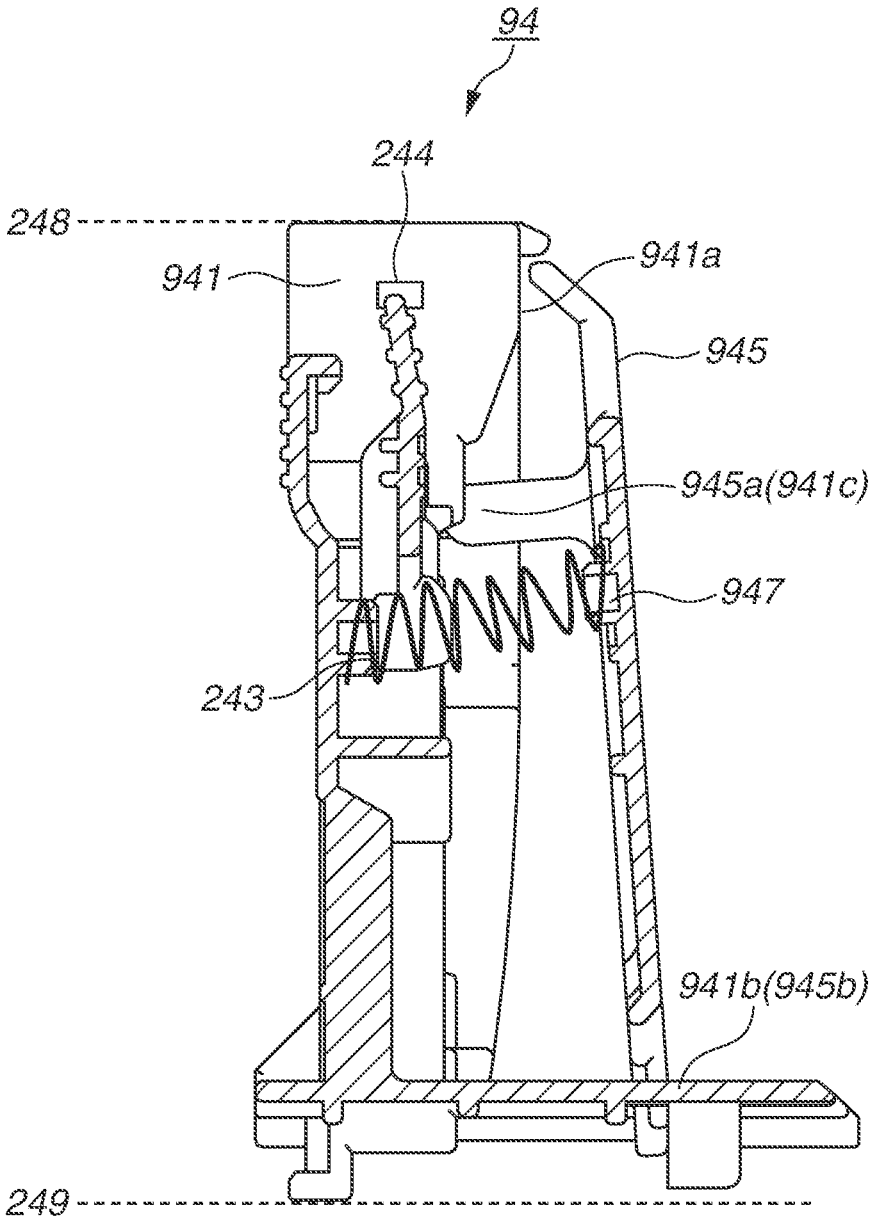
FIG. 9 is a cross-sectional view of the regulating unit according to the second exemplary embodiment of the present disclosure.

A component having the same configuration and function as those of the first exemplary embodiment is denoted by the same reference numeral as that of the first exemplary embodiment, and repeated description will be omitted. FIG. 8 is a perspective view of the regulating unit 94 that positions the rear edge of the sheets S stacked in the sheet storage unit 21. FIG. 9 is a cross-sectional view of the regulating unit 94. FIGS. 10A to 10C and FIGS. 11A to 11C illustrate the second exemplary embodiment of the present disclosure.

The pressing member 945 has a pressing member shaft portion 945*a* located on both ends and fitting in an opening portion 941*c* of the supporting portion 941, so that the pressing member 945 can linearly move in a direction d in which the opening portion 941*c* extends and rotate about the pressing member shaft portion 945*a*. The length of the opening portion 941*c* in the direction in which the pressing member 945 serving as the pressing portion linearly moves is longer than a length of the opening portion 941*c* in a direction orthogonal to the direction in which the pressing member 945 linearly moves.

In other words, the pressing member 945 is supported by the supporting portion 941 and the opening portion 941*c* thereof so that the pressing member 945 is linearly movable and rotatable.

The opening portion 941*c* is also located at a position closer to an upper end 248 than to a lower end 249 of the regulating unit 94 in the vertical direction. In the pressing member 945, the urged portion 947 is urged toward the sheets S by an urging member 243 of the regulating unit 94, as with the first exemplary embodiment.

In a state where the sheets S are not present in the sheet storage device 2, the pressing member 945 is urged by the urging member 243 as illustrated in FIG. 9, and is in a state where the pressing member 945 protrudes in the rightward direction in FIG. 9 further than the supporting portion 941. The pivotal movement of the pressing member 945 is regulated by bringing a pressing member contact portion 945*b* of the pressing member 945 into contact with a contacted portion 941*b* of the supporting portion 941.

The urged portion 947 is located at a position lower than the opening portion 941*c*, and closer to the upper end 248 than to the lower end 249 of the regulating unit 94, in the vertical direction. It is desirable to dispose the urged portion 947 at such a position, in order to obtain effect of preferentially pushing out the upper sheets S. However, the urged portion 947 may be disposed anywhere as long as the urged portion 947 is located higher than the lowermost sheet among the sheets S stored in the sheet storage unit 21.

The pressing member 945 is configured to enable an upper part to pivot even if a lower part does not move, when the urging force of the urging member 243 is applied. Based on the above-described configuration, the pressing member 945 preferentially pushes out the upper side of the stacked sheets S.

Similarly to the first exemplary embodiment, the urging position and the urging force are set to balance a force of pushing out upper sheets among the stacked sheets S and a force of preventing buckling of the bundle of the sheets S. The pivotal movement posture of the pressing portion is determined such that a desirable amount of pressing force at the time of each height of the stacked sheets S can be secured.

The state of the pressing member 945 when the sheets S are stacked in the sheet storage device 2 will be described with reference to FIGS. 10A to 10C and FIGS. 11A to 11C, in a case where the quantity of the stacked sheets S is each of three patterns, i.e., the third quantity, the first quantity, and the second quantity. Each of the quantities and the relationship thereof are similar to those of the first exemplary embodiment, but the second exemplary embodiment is not limited to these quantities.

Figure 10A:
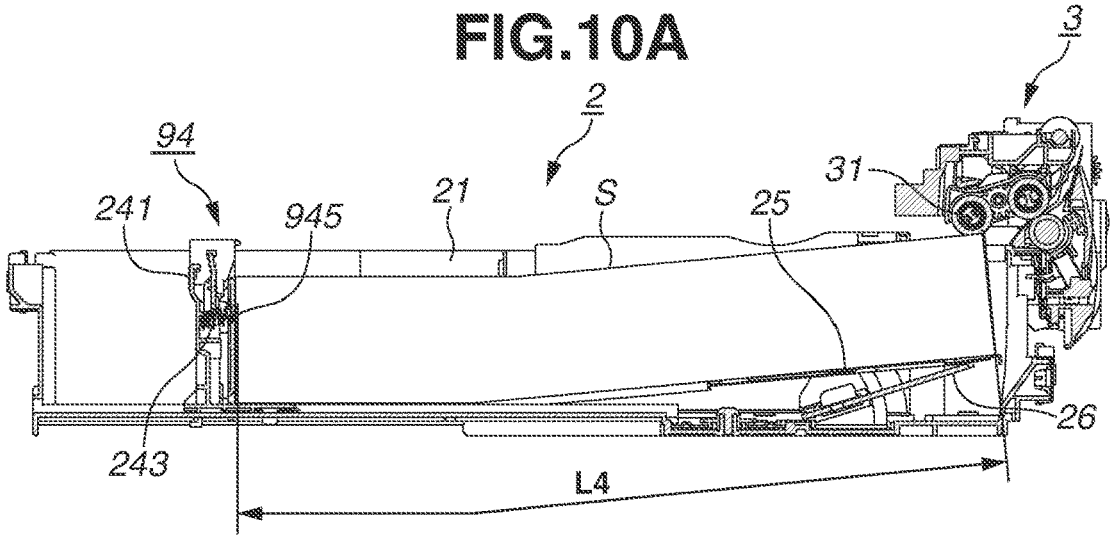
FIGS. 10A to 10C are cross-sectional views each illustrating a use state of a sheet storage device according to the second exemplary embodiment of the present disclosure.
Figure 10B:
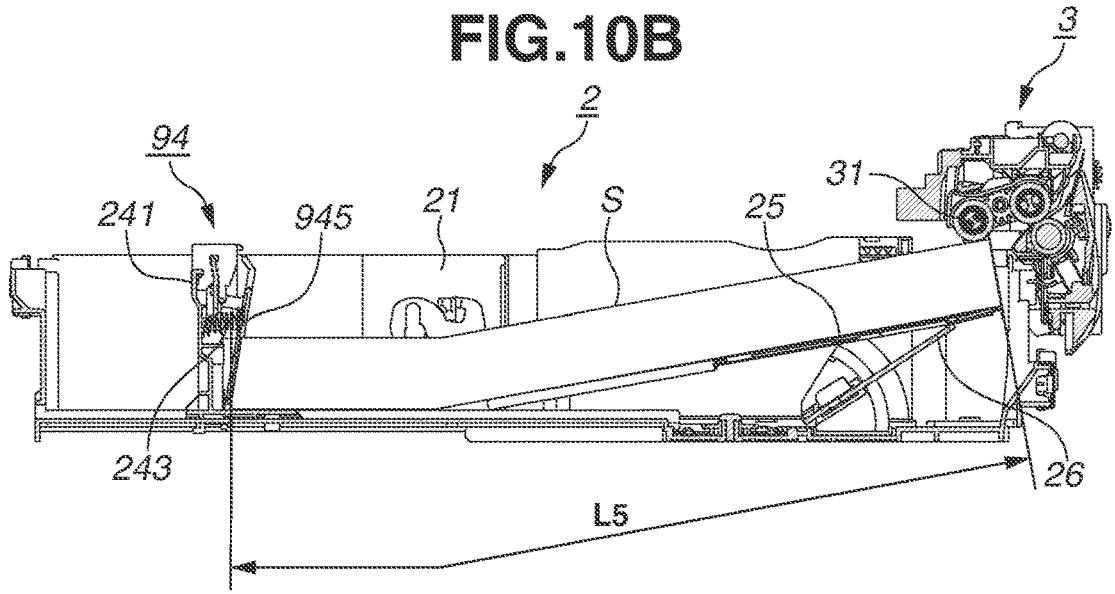
Figure 10C:
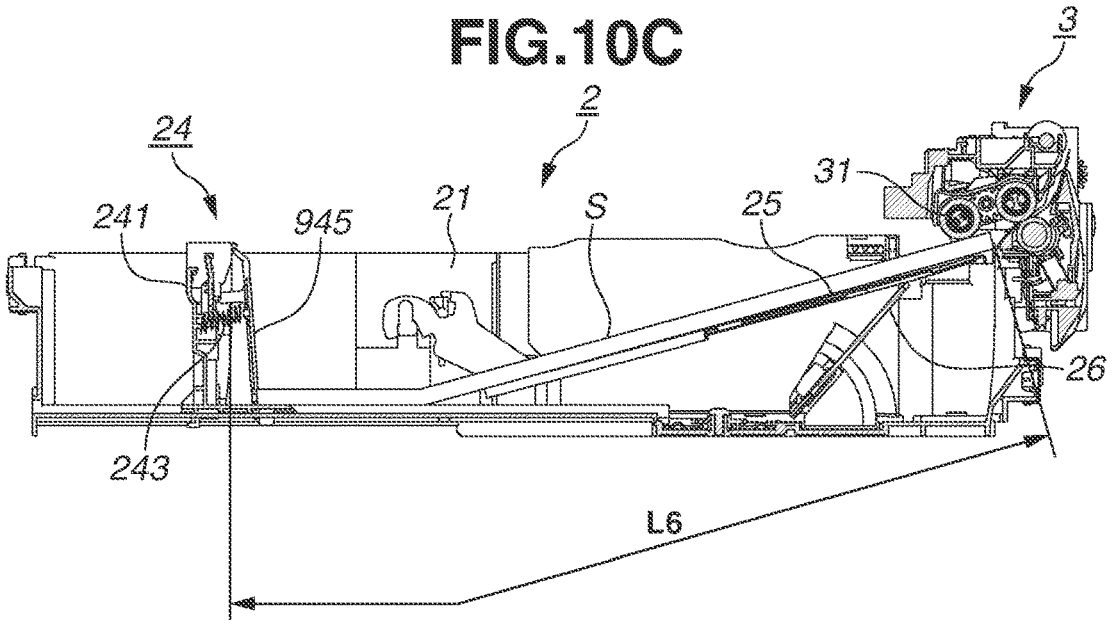

There will be considered a state where the pressing portion 900 is not present, the rear edge portion of the sheets S is regulated by the regulating unit, and the front edge of the sheets S is lifted up. In the state where the quantity of the sheets S is the third quantity, as illustrated in FIG. 10A, a distance L4 from the rear edge of the uppermost sheet of the stacked sheets to the contact point between the sheet and the sheet feeding roller 31 along the surface of this sheet is the shortest distance. The distance when the quantity of the sheets S is the first quantity is a distance L5, as illustrated in FIG. 10B, and this distance is longer than the distance L4. Further, the distance when the quantity of the sheets S is the second quantity is a distance L6, as illustrated in FIG. 10C, and this distance is longer than the distance L5.

Figure 11A:
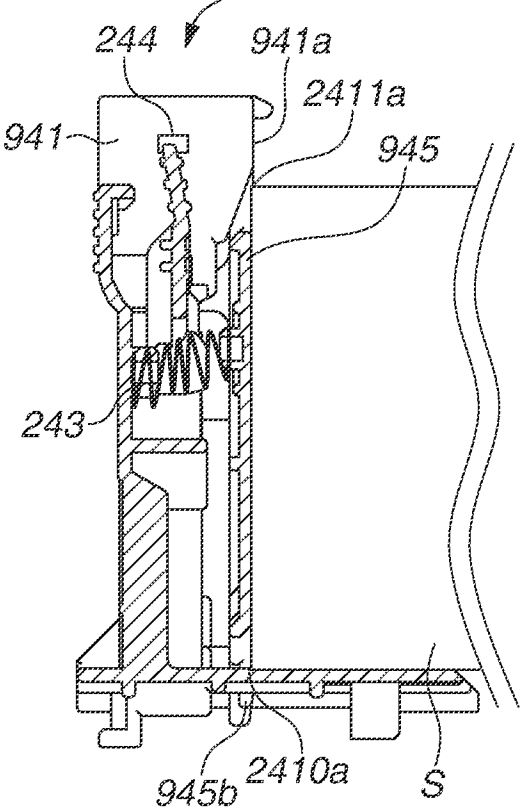
FIGS. 11A to 11C are cross-sectional views each illustrating a use state of the regulating unit according to the second exemplary embodiment of the present disclosure.

The configuration of the present exemplary embodiment in which the pressing portion 900 is present will now be described. When the quantity of the stacked sheets is the third quantity, as illustrated in FIG. 11A, the pressing member 945 is in contact with the rear edge of the sheets S, in a state of not protruding from the supporting portion 941, while urging the sheets S (the third state).

Figure 11B:
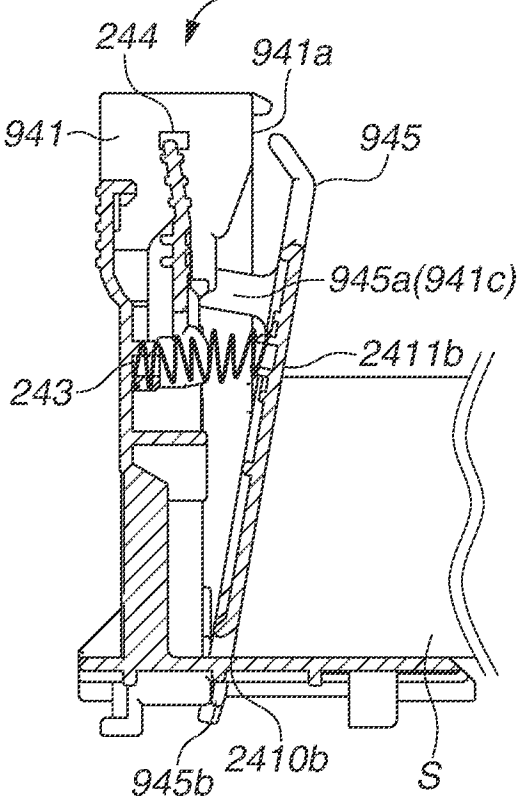
Figure 11C:
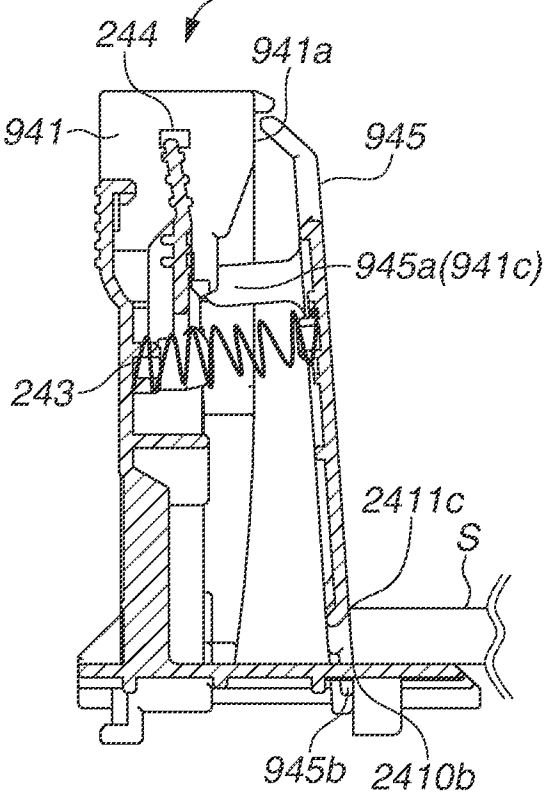

When the quantity of the stacked sheets S is the first quantity, the pressing member 945 inclines as illustrated in FIG. 11B. The pressing surface upper portion and the pressing surface lower portion at this moment will be referred to as a pressing surface upper portion 2411*b* and a pressing surface lower portion 2410*b*, respectively. Here, the position of the pressing surface lower portion 2410*b* is a position corresponding to the lowermost sheet among the sheets stacked in the sheet storage unit 21 in the height direction. The position of the pressing surface upper portion 2411*b* is a position corresponding to the uppermost sheet. Further, as with the first exemplary embodiment, a direction parallel to the horizontal direction and toward the downstream side in the conveyance direction is a pressing direction. As to the contact surface (the pressing surface) between the pressing member 945 and the sheets S, the pressing surface upper portion 2411*b* is located downstream from the pressing surface lower portion 2410*b* in the pressing direction (the first state). In other words, the surface 945*c* of the pressing member 945 is in an inclined state such that the upper end of the surface 945*c* is located downstream from the lower end of the surface 945*c*, in the pressing direction. In this state, the pressing surface and the surface 945*c* face downward in the vertical direction.

Even in this state, the pressing surface pivots, so that the uppermost sheet S to be fed next by the sheet feeding roller 31 is moved in the conveyance direction, and the contact distance decreases. As described above, the increased contact distance is adjusted.

The reason for such an inclination is that a force applied from the sheets S to the pressing surface upper portion 2411*b* is smaller than a force applied to the pressing surface lower portion 2410*b*. The pressing surface lower portion 2410*b* is thereby not pivoted by the sheets S, and the pressing surface upper portion 2411*b* is pivoted by the urging force, and inclines as illustrated in FIG. 11B.

Since the surface 945*c* and the pressing surface incline as described above, the pressing member 945 can press the upper sheets S to move the upper sheets S toward the sheet feeding roller 31. In other words, since the surface 945*c* and the pressing surface incline as described above, it is not necessary for the pressing member 945 to move the whole bundle of sheets stored in the sheet storage unit 21 in a state where the quantity of the sheets is large.

When the quantity of the stacked sheets S is the second quantity, a position corresponding to the lowermost sheet among the sheets S stacked in the sheet storage unit 21 in the height direction is a pressing surface lower portion 2410*c*, and a position corresponding to the uppermost sheet is a pressing surface upper portion 2411*c*, of the pressing surface. Concerning the contact surface (the pressing surface) between the pressing member 945 and the sheets S, the pressing surface lower portion is located downstream from the pressing surface upper portion in the pressing direction (the second state). In other words, this is a state where the surface 945*c* of the pressing member 945 inclines such that the lower end of the surface 945*c* is located downstream from the upper end of the surface 945*c* in the pressing direction. In this state, the pressing surface and the surface 945*c* face upward in the vertical direction.

Even in this state, the pressing surface pivots, so that the uppermost sheet S to be fed next by the sheet feeding roller 31 is moved in the conveyance direction, and the contact distance decreases. The distance for pushing out the uppermost sheet in the second state is longer than that in the first state. In this way, the increased contact distance is adjusted.

Even in the present exemplary embodiment, the position of the pressing surface upper portion and the position of the pressing surface lower portion are the position corresponding to the uppermost sheet and the position corresponding to the lowermost sheet among the sheets stacked in the sheet storage unit 21, respectively, but are not limited thereto.

As described above, as with the first exemplary embodiment, the configuration of the second exemplary embodiment makes it possible for the pressing portion 900 to push up the stacked sheets such that the sheet feeding roller 31 can be in contact with a predetermined position of the stacked sheets regardless of the quantity of the stacked sheets S. Thus, variations in the position of the sheet S when conveyance starts can be reduced, and stable sheet feeding can be achieved.

In the present exemplary embodiment, a helical compression spring is used for the urging member 243 as with the first exemplary embodiment, but other type of member, such as a torsion coil spring or a flat spring, may be used as long as the member generates an urging force.

According to the exemplary embodiments of the present disclosure, it is possible for the pressing portion to push up the stacked sheets such that the sheet feeding roller can be in contact with a predetermined position of the stacked sheets regardless of the quantity of the stacked sheets, and therefore, variations in the sheet position when conveyance starts can be reduced.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

What is claimed is:

1. A sheet storage device comprising:

a sheet storage unit configured to store sheets;

a regulating unit disposed in the sheet storage unit, and configured to regulate a position of a rear edge portion of the sheets in a conveyance direction for the sheets, wherein the regulating unit includes a pressing portion having a pressing surface configured to press the rear edge portion, a supporting portion configured to support the pressing portion, and an urging member configured to urge the pressing portion to cause the pressing surface to press the sheets; and a lifting unit configured to lift a front edge portion of the sheets in the conveyance direction, wherein, in the pressing surface, a position to be in contact with lower sheets is a pressing surface lower portion, and a position to be in contact with upper sheets located higher than the lower sheets is a pressing surface upper portion, wherein, depending on a quantity of the sheets stored in the sheet storage unit, the pressing surface is capable of taking a first state and a second state in a state where the lifting unit lifts the front edge portion of the sheets so that the pressing surface is (i) in the first state when the quantity of the sheets stored in the sheet storage unit is a first quantity and (ii) in the second state when the quantity of the sheets stored in the sheet storage unit is a second quantity, and wherein, in a case where a direction parallel to a horizontal direction and toward a downstream side in the conveyance direction is a pressing direction, the pressing surface upper portion is located downstream from the pressing surface lower portion in the pressing direction when the pressing surface is in the first state, and the pressing surface lower portion is located downstream from the pressing surface upper portion in the pressing direction when the pressing surface is in the second state.

2. The sheet storage device according to claim 1, wherein, the first quantity is larger than the second quantity.

3. The sheet storage device according to claim 2, wherein, in a case where the quantity of the sheets stored in the sheet storage unit is a third quantity that is larger than the first quantity, the pressing surface can be in a third state, and wherein a third angle formed by the pressing surface and a vertical direction when the pressing surface is in the third state is smaller than both a first angle formed by the pressing surface and the vertical direction when the pressing surface is in the first state, and a second angle formed by the pressing surface and the vertical direction when the pressing surface is in the second state.

4. The sheet storage device according to claim 1, wherein the pressing portion includes a first portion pivotably supported by the supporting portion, and includes a second portion pivotably engaged with the first portion and located below the first portion in a vertical direction.

5. The sheet storage device according to claim 4, wherein the first portion and the second portion are engaged with each other at an engagement portion, and the engagement portion is located at a position closer to an upper end of the regulating unit than to a lower end of the regulating unit in the vertical direction.

6. The sheet storage device according to claim 5, wherein the urging member is configured to urge an urged portion of the pressing portion, and the urged portion is located at a position lower than the engagement portion and closer to the upper end of the regulating unit than to the lower end of the regulating unit in the vertical direction.

7. The sheet storage device according to claim 1, wherein the supporting portion has an opening portion configured to support the pressing portion to make the pressing portion linearly movable and rotatable.

8. The sheet storage device according to claim 7, wherein, in the opening portion, a length in a direction in which the pressing portion linearly moves is longer than a length in a direction orthogonal to the direction in which the pressing portion linearly moves.

9. The sheet storage device according to claim 7, wherein the opening portion is located at a position closer to an upper end of the regulating unit than to a lower end of the regulating unit in a vertical direction.

10. The sheet storage device according to claim 9, wherein the urging member is configured to urge an urged portion of the pressing portion, and the urged portion is located at a position lower than the opening portion and closer to the upper end of the regulating unit than to the lower end of the regulating unit in the vertical direction.

11. An image forming apparatus comprising:

the sheet storage device according to claim 1; and an image forming unit configured to form an image on a sheet.

* * * * *